US008341920B2

(12) United States Patent
Tavarez

(10) Patent No.: US 8,341,920 B2
(45) Date of Patent: Jan. 1, 2013

(54) METAL DOOR

(75) Inventor: Anibal J. Tavarez, Monte Cristi (DO)

(73) Assignee: Everlast Doors Industries, SA, Monte Cristi (DO)

( * ) Notice: Subject to any disclaimer, the term of this patent is extended or adjusted under 35 U.S.C. 154(b) by 627 days.

(21) Appl. No.: 12/184,536

(22) Filed: Aug. 1, 2008

(65) Prior Publication Data

US 2010/0024309 A1 Feb. 4, 2010

(51) Int. Cl.
*E04C 2/34* (2006.01)

(52) U.S. Cl. ..... 52/792.1; 52/800.12; 52/458

(58) Field of Classification Search ..... 52/784.1, 52/309.9, 309.14, 784.12, 784.13, 792.1, 52/800.12, 458; 49/501, 506
See application file for complete search history.

(56) References Cited

U.S. PATENT DOCUMENTS 537,337 A * 4/1895 Bobb ..... 52/455
993,483 A * 5/1911 Wege ..... 52/792.11
1,015,212 A * 1/1912 Schaffert ..... 52/458
1,848,715 A * 3/1932 Hart ..... 52/784.13
2,023,661 A * 12/1935 Beyrle ..... 52/784.11
2,248,777 A * 7/1941 Peelle et al. ..... 52/784.12
2,278,331 A * 3/1942 Meyercord ..... 52/573.1
2,664,182 A * 12/1953 Williams et al. ..... 52/784.13
2,692,664 A * 10/1954 Ternes ..... 52/222
2,787,345 A * 4/1957 Soubier et al. ..... 52/232
3,121,264 A * 2/1964 Hammar ..... 52/784.15
3,334,464 A * 8/1967 Charles ..... 52/784.15
3,336,713 A * 8/1967 Privas ..... 52/573.1
3,455,078 A * 7/1969 Brown et al. ..... 52/784.13
3,512,305 A * 5/1970 Multer ..... 49/503
3,633,312 A * 1/1972 Yeager et al. ..... 49/503
3,786,609 A * 1/1974 Difazio ..... 52/784.13
3,786,613 A * 1/1974 Shepheard ..... 52/784.13
3,789,550 A 2/1974 Seiwert
3,987,588 A 10/1976 Imperial et al.
4,148,157 A * 4/1979 Franc ..... 49/501
4,281,479 A * 8/1981 Daus ..... 49/503
4,281,481 A 8/1981 Wendt
4,327,535 A * 5/1982 Governale ..... 52/309.11
4,344,254 A 8/1982 Varlonga
4,438,597 A * 3/1984 Maggart ..... 49/501
4,589,240 A * 5/1986 Kendall et al. ..... 52/309.11
4,646,494 A * 3/1987 Saarinen et al. ..... 52/232
4,819,383 A * 4/1989 McKann et al. ..... 49/501
4,888,918 A * 12/1989 Green et al. ..... 49/501
4,896,458 A * 1/1990 McKann et al. ..... 49/501
4,897,971 A * 2/1990 Durston ..... 52/238.1
4,937,978 A 7/1990 Johansson et al.
(Continued)

*Primary Examiner* — William Gilbert
*Assistant Examiner* — James Ference
(74) *Attorney, Agent, or Firm* — Alston & Bird LLP

(57) ABSTRACT

The present invention is directed to a metal door. The door includes a pair of sheet metal door panels. Each of the door panels includes a central body portion with top, bottom and opposing side edges. The doors include an integral flange along each side edge of each panel. The integral flange extends generally perpendicular to the central body portion. An integral inturned lip can be located along each flange and extend substantially parallel to the central body portion. The door panels are positioned such that the central body portions are in an opposing spaced apart relation to one another with the flanges adjacent to and aligned with one another. The inturned lips are positioned in contacting face-to-face relation. The metal door also includes an elongate connector overlying and clamping together each face-to-face pair of inturned lips to maintain the door panels in assembled relation.

15 Claims, 5 Drawing Sheets

U.S. PATENT DOCUMENTS

| | | | | |
|---|---|---|---|---|
| 4,974,366 | A | 12/1990 | Tizzoni | |
| 5,018,263 | A | 5/1991 | Stern | |
| 5,036,638 | A * | 8/1991 | Kurtz, Jr. | 52/284 |
| 5,448,872 | A * | 9/1995 | Thompson et al. | 52/784.13 |
| 5,570,560 | A * | 11/1996 | Thompson et al. | 52/784.13 |
| 5,839,252 | A * | 11/1998 | Berghorn et al. | 52/784.13 |
| 6,061,995 | A * | 5/2000 | Menchetti et al. | 52/794.1 |
| 6,098,368 | A * | 8/2000 | McKann | 52/784.13 |
| 6,132,540 | A * | 10/2000 | Barber et al. | 156/78 |
| 6,161,363 | A * | 12/2000 | Herbst | 52/784.15 |
| 6,311,454 | B1 * | 11/2001 | Kempel | 52/784.15 |
| 6,321,505 | B1 * | 11/2001 | Packman et al. | 52/784.13 |
| 6,389,769 | B1 * | 5/2002 | McKinney et al. | 52/309.9 |
| 6,453,638 | B2 * | 9/2002 | Chen | 52/784.15 |
| 6,485,122 | B2 * | 11/2002 | Wolf et al. | 312/406.2 |
| 6,619,010 | B2 * | 9/2003 | Wang Chen | 52/784.13 |
| 6,622,449 | B2 * | 9/2003 | Smith et al. | 52/656.9 |
| 6,854,215 | B1 | 2/2005 | Kaiser | |
| 7,043,816 | B2 | 5/2006 | Zaluzec et al. | |
| 7,370,454 | B2 * | 5/2008 | Lynch et al. | 52/784.1 |
| 7,748,120 | B2 * | 7/2010 | Turner et al. | 29/897.31 |
| 7,823,353 | B2 * | 11/2010 | Lynch et al. | 52/455 |
| 2001/0003889 | A1 * | 6/2001 | Zen | 52/784.1 |
| 2003/0084639 | A1 * | 5/2003 | Wang Chen | 52/784.1 |
| 2003/0140587 | A1 * | 7/2003 | Smith et al. | 52/455 |
| 2003/0200714 | A1 * | 10/2003 | Minke et al. | 52/423 |
| 2004/0003559 | A1 * | 1/2004 | Minke et al. | 52/309.9 |
| 2004/0245676 | A1 | 12/2004 | Zaluzec et al. | |
| 2007/0028559 | A1 * | 2/2007 | Lynch et al. | 52/784.1 |
| 2008/0251183 | A1 * | 10/2008 | Turner | 156/79 |

* cited by examiner

METAL DOOR

BACKGROUND OF THE INVENTION

1. Field of the Invention

The present invention relates generally to metal doors and to a method of making a metal door.

2. Description of Related Art

Metal doors with insulating cores have enjoyed substantial popularity due to their strength and their temperature and sound insulating qualities. Many types of metal doors generally require, at least to some extent, welding the door components together to secure the individual pieces into an assembled door. One drawback to such doors, however, is that the process of producing them is comparatively labor intensive and involves multiple steps. In addition to the direct costs of the labor involved, the manufacturing process can result in variability in the dimensions of the product and in poor joints. Such processes result in waste, scrap and rejected units, all of which further increase the cost of the marketable units.

Accordingly, there remains a need for metal doors which are strong, durable and economical to produce. Additionally, there is a need for a method of making a metal door with increased efficiency and economy in a manner suitable for commercial mass production.

BRIEF SUMMARY OF THE INVENTION

The present invention satisfies at least some of the aforementioned needs by providing a metal door that is preferably devoid of welds. The door includes a pair of sheet metal door panels. Each of the door panels includes a central body portion with top, bottom and opposing side edges. Metal doors according to these embodiments include an integral flange along each side edge of each panel. The integral flange extends generally perpendicular to the central body portion of the door panel. An integral inturned lip can be located along each flange and extends substantially parallel to the central body portion of the door panel. The door panels are positioned such that the central body portions are in an opposing spaced apart relation to one another with the flanges adjacent to and aligned with one another. In such a configuration, the inturned lips are positioned in contacting face-to-face relation. The metal door also includes at least one elongate connector overlying and clamping together each face-to-face pair of inturned lips to maintain the door panels in assembled relation.

In various embodiments, the metal door can comprise a pair of rectangular sheet metal door panels, each having a central body portion with top, bottom and opposing side edges. Doors according to these embodiments also include an integral flange along each side edge of each panel extending perpendicular to the central body portion of the door panel and an integral inturned lip along each flange extending substantially parallel to the central body portion of the door panel. The door panels are positioned with the central body portions being in opposing spaced apart relation to one another with the flanges adjacent to and aligned with one another. As such, the inturned lips are positioned in contacting face-to-face relation. The metal doors also include an elongate connector or connectors overlying and clamping together each face-to-face pair of inturned lips to maintain the door panels in assembled relation. Preferably, the connector comprises an elongate metal strip with a longitudinally extending bend formed in a central portion of the strip and defining a generally U-shaped channel with opposed, generally parallel side walls. Accordingly, the face-to-face pair of inturned lips is positioned in the channel and surrounded by the side walls. In preferred embodiments, the metal door also includes top and bottom rails positioned between the door panels and extending respectively along the top and bottom edges thereof, wherein each rail includes a central body portion and an integral flange along each side edge of each rail extending perpendicular to the central body portion. In one embodiment, a 180 degree U-bend is formed in the sheet metal of said door panels along said top and bottom edges, so that a portion of the sheet metal of the door panel adjacent said bend overlies and clamps onto said integral flange of each rail.

In another aspect, the present invention provides a method of making a metal door. Methods according to various embodiments of the present invention can comprise providing a pair of sheet metal door panels, each of which having a central body portion with top, bottom and opposing side edges. The method also includes forming an integral flange along at least a portion of each side edge of each panel such that each integral flange extends perpendicular to the central body portion of the door panel. Such embodiments can also include forming an integral inturned lip along each flange extending substantially parallel to the central body portion of the door panel. Embodiments of the present invention also include positioning the door panels such that the central body portions of the door panels are in opposing spaced apart relation to one another with the flanges adjacent to and aligned with one another and with the inturned lips positioned in contacting face-to-face relation. Preferred embodiments include positioning an elongate connector or connectors such that the connector(s) overlie each face-to-face pair of inturned lips. Next, pressure is applied to the assembled door panels and elongate connector to crimp the inturned lips and connector(s) to secure the door panels in assembled relation.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
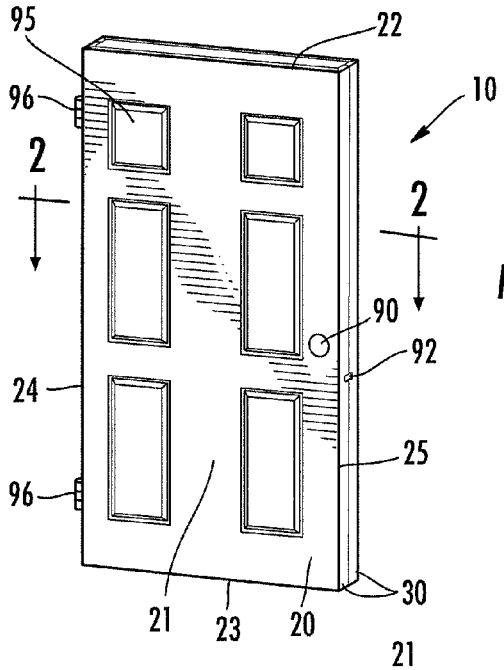
FIG. 1 illustrates an assembled door according to one embodiment of the present invention.

FIG. 1 illustrates an assembled metal door 10 according to certain embodiments of the present invention. In FIG. 1, the assembled metal door 10 comprises a pair of sheet metal door panels 20 each having a circular hole 90 formed in the panels adjacent to one side edge for receiving a lockset. The assembled door 10 also preferably includes a rectangular hole 92 in the side edge of the door adjacent the circular hole 90 for receiving the striker portion of a lockset. In preferred embodiments, the metal door 10 also includes hinges 96 pre-attached to a side edge of the door opposite the rectangular hole 92. If desired, the sheet metal of the door panels 20 can include decorative relief panel formations 95 stamped in the central body portion 21 of the door panels 20.

Each door panel 20 includes a central body portion 21 with a top edge 22, a bottom edge 23 and opposing side edges 24 and 25. The door panels 20 according to such embodiments also include an integral flange 30 along at least a portion of each side edge 24, 25 of each panel extending generally perpendicular to the central body portion 21 of the door panel and an integral inturned lip 34 along at least a portion of each flange 30. The integral flange 30 of each door panel 20 is substantially perpendicular to the central body portion 21 of each door panel, while the inturned lips 34 are substantially parallel to the central body portion 21. In preferred embodiments, the integral flange 30 and the inturned lip 34 extend substantially continuously from the top edge 22 to the bottom edge 23 of the door panels 20.

Figure 2:
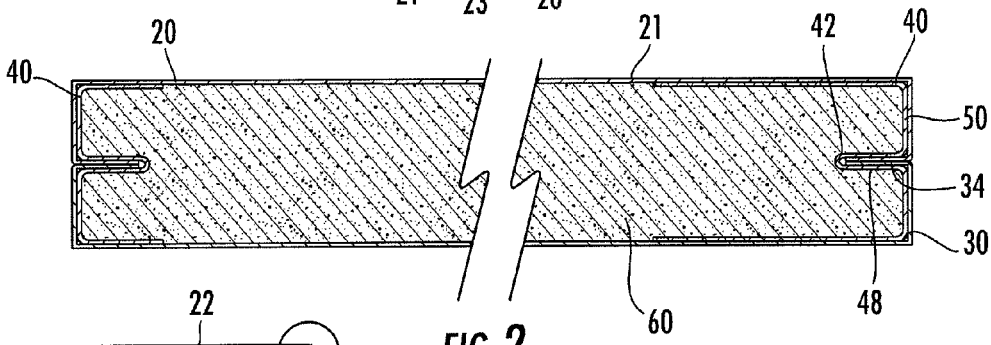
FIG. 2 is a cross-sectional view taken along line 2-2 of FIG. 1.
Figure 4:
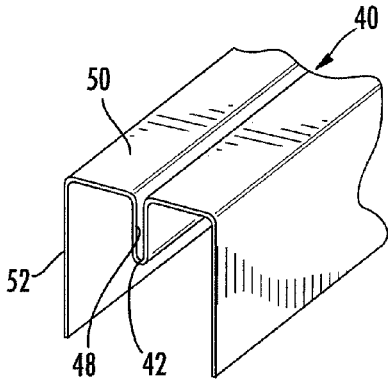
FIG. 4 illustrates an elongate connector according to one embodiment of the present invention.

As best seen in FIG. 2, an assembled metal door 10 includes the door panels 20, which are positioned such that the central body portions 21 are in opposing spaced apart relation to one another with the integral flanges 30 adjacent to and aligned with one another. Moreover, the inturned lips 34 are positioned in a contacting face-to-face relation. The door panels 20 are held together by an elongate connector 40, or alternatively multiple elongate connectors, overlying and clamping together each face-to-face pair of inturned lips 34 to hold and maintain the door panels in assembled relation. In such embodiments, the elongate connectors 40 comprise elongate metal strips, each with a longitudinally extending bend 42 formed in a central portion of the strip. The longitudinally extending bend defines a generally U-shaped channel. The U-shaped channel includes opposed, generally parallel side walls 48 (FIG. 4). Each face-to-face pair of inturned lips 34 can be positioned in the channel surrounded by the side walls 48. As shown in FIG. 2, the opposing spaced apart door panels 20 in an assembled relation define an interior cavity 60 within the door. In one preferred embodiment, the interior cavity is substantially filled with expandable foam. Preferably, the foam comprises polyurethane foam.

Figure 3A:
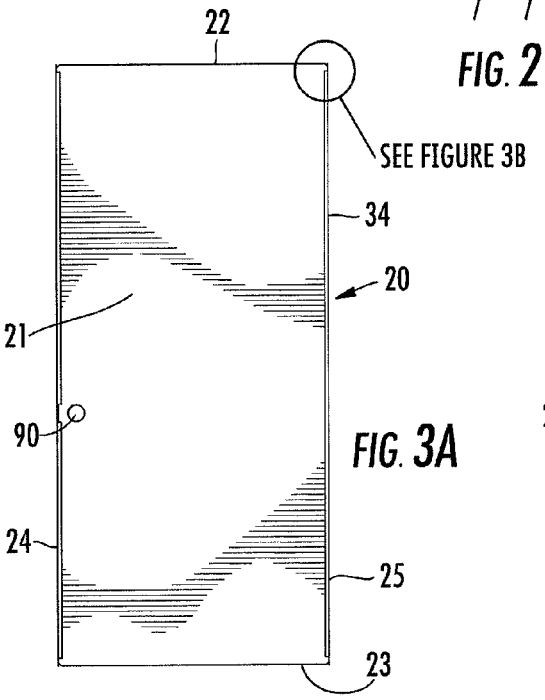
FIG. 3A is a rear view of a door panel according to one embodiment of the present invention.
Figure 3B:
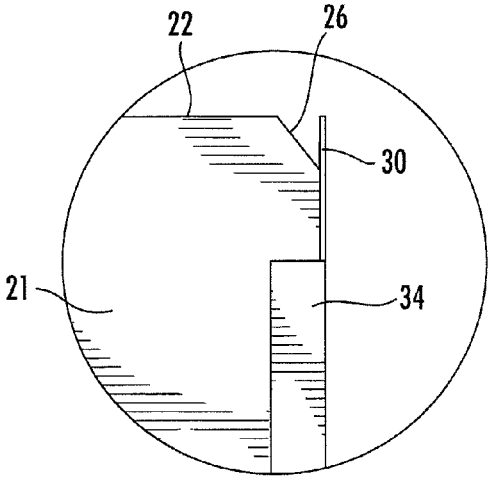
FIG. 3B is an exploded detail view of a corner of a door panel as shown in FIG. 3A.

FIG. 3A illustrates a rear view of an individual door panel 20 according to one embodiment of the present invention. As shown in FIG. 3A, the door panel 20 is indicated at 21 and includes a top edge 22, a bottom edge 23 and opposing side edges 24 and 25. Additionally, the door panel 20 includes a pair of integral inturned lips 34 along at least a portion of each integral flange 30 (best seen in FIG. 3B). Each door panel 20 also includes a circular hole 90 adjacent one side edge 24 and a rectangular hole 92 formed in the flanges 30 adjacent to the circular hole 90 for receiving the striker portion of a lockset. As shown in FIG. 3B, which illustrates a detailed view of a corner of a door panel 20 according to an embodiment shown in FIG. 3A, the integral flanges 30 formed along opposite side edges 24, 25 are preferably perpendicular to the central body portion 21 of the door panel 20 and extend substantially continuously from the bottom edge 23 to the top edge 22 of the door panel 20. The door panel 20 also includes integral inturned lips 34 which are generally parallel to the central body portion 21 of the door panel 20 and substantially perpendicular to the integral flanges 30.

As best shown in FIGS. 3A and 3B, both the top edge 22 and the bottom edge 23 include slanted cut-outs each extending from the outer most portion of respective edges 22, 23 inward and towards the respective side edge 24, 25 to define inwardly slanted top and bottom edge portions 26. Preferably, the inwardly slanted edge portions 26 project inward at about a 45 degree angle from the respective top or bottom edge 22, 23. However, in alternative embodiments, the inwardly slanted edge portions 26 can each project inward at an angle from about 20 degrees to about 70 degrees, or from about 35 degrees to about 55 degrees from the respective top or bottom edge 22, 23. Likewise, each integral flange 30 includes a corresponding slanted cut-out 27 (shown in FIG. 7) extending from the top or bottom edge 22, 23 of the integral flange 30 inward and converging with the inwardly slanted top and bottom edge portions 26 at the respective side edge 24, 25.

FIG. 4 illustrates the elongate connector 40 in greater detail. The elongate connector 40 includes a longitudinally extending bend 42, which defines a generally U-shaped channel. The U-shaped channel includes opposed, generally parallel side walls 48. The elongate connector 40 also includes outturned flange portions 50 joined to the side walls 48 by right angle bends such that when the elongate connector 40 overlies the door panels 20 the outturned flange portions 50 are adjacent and parallel to the integral flanges 30 of the door panels 20. Additionally, the elongate connector 40 includes integral downturned leg portions 52 joined to the outturned flange portions 50 by a right angle bend such that when the elongate connector 40 overlies the door panels 20 the downturned leg portions 52 are adjacent and parallel to the central body portions 21 of the door panels 20.

The side walls 48 of an elongate connector 40 preferably range from about 0.25" to about 1", more desirably from about 0.40" to about 0.8", and most preferably from about 0.4" to about 0.6". The length of the outturned flange portions 50 and the integral downturned leg portions 52 can also be varied depending on the desired overall thickness and end use for a particular door. For example, the outturned flange portions 50 can range from about 0.5" to about 1.5", or from about 0.6" to about 1.25", or from 0.7" to about 1.0". Most preferably, the length of the outturned flange portions 50 are about 0.85". The integral downturned leg portions 52 can range from about 0.5" to about 5". The elongate connector 40 used on the side of the door 10 where the lockset is located is preferably larger and typically the elongate connector 40 used on the side of the door opposite the lockset can be smaller. Preferably, the length of the downturned leg portions 52 of the elongate connector 40 used on the side of the door opposite the lockset according to this embodiment are about 1.0". The elongate connector 40 used on the side of the door where the lockset is located includes integral downturned leg portions 52 having a length ranging from about 1.5" to about 5", more desirably from 2.0" to about 4.5". Preferably, the length of the downturned leg portions 52 according to this embodiment range from about 3.75" to about 3.85". Stated differently, a first elongate connector 40 overlies and clamps together the face-to-face pair of inturned lips 34 adjacent circular hole 90 and the side edge 24 having rectangular hole 92, in which the downturned leg portions 52 of the elongate connector 40 have a length greater than the downturned leg portions 52 of a second elongate connector 40 for clamping the inturned lips 34 adjacent side edge 25. More preferably, the downturned leg portions 52 of the first elongate connector are the same or substantially similar in length to that of the side walls 51 of a lockset housing 58, which is discussed below.

Depending on the thickness of the metal used to assemble the door 10, the width of the U-shaped channel can be varied to accommodate the inturned lips 34 of the door panels 20. For instance, the U-shaped channel can range from 1/16" to about 1/4" in width. Merely by way of example, if the metal thickness of the inturned lips 34 is about 1/32", than the width of the U-shaped channel is preferably about 1/16".

Figure 5A:
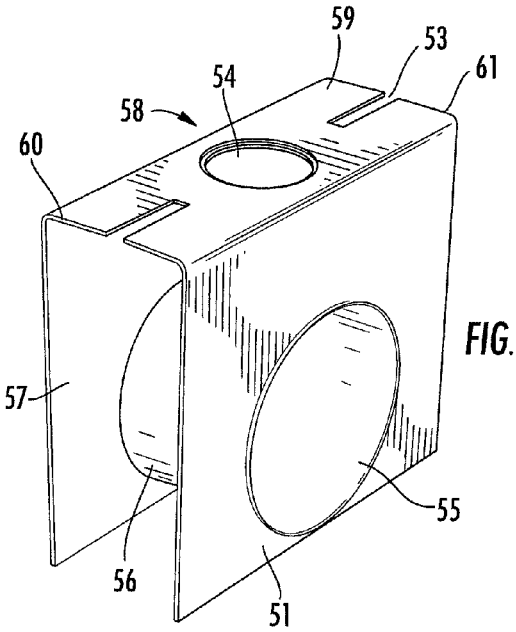
FIG. 5A illustrates a lockset housing according to one embodiment of the present invention.
Figure 5B:
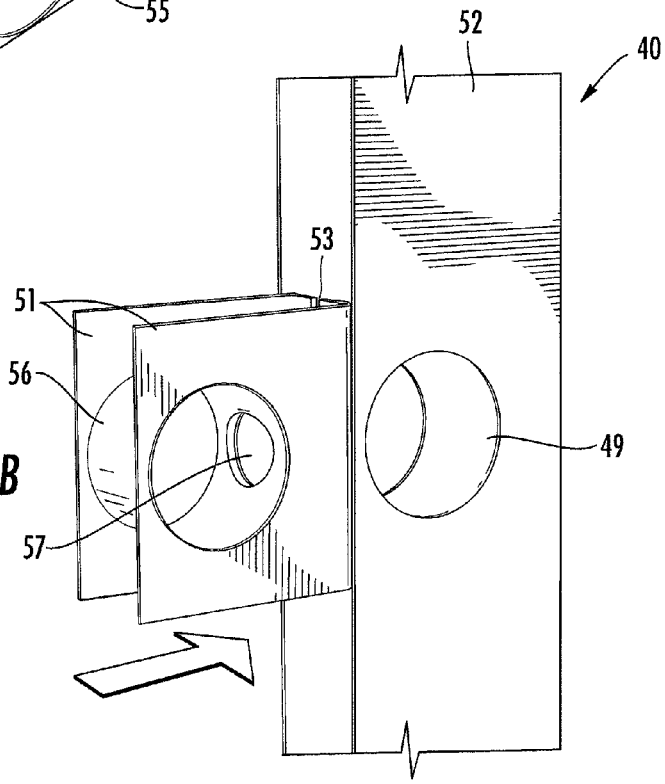
FIG. 5B illustrates the positioning of a lockset housing between downturned leg portions of an elongate connector.

To enable the door 10 to accommodate a conventional lockset, a lockset housing 58 is mounted to one of the elongate connectors 40. FIG. 5A illustrates a lockset housing 58 according to one embodiment of the present invention, while FIG. 5B illustrates the positioning of the lockset housing 58 between the downturned leg portions 52 of an elongate connector 40. The lockset housing 58 includes substantially parallel side walls 51 joined by an integral central wall 59 via respective right angle bends such that the central wall 59 is substantially perpendicular to the side walls 51. The lockset housing 58 also includes opposing side edges 60, 61. The central wall 59 includes a hole 54 for receiving a striker portion of a lockset and rectangular cut-outs 53 adjacent each side edge 60,61. Each rectangular cut-out 53 is positioned and sized to accommodate a portion of a U-shaped channel of an elongate connector 40. Accordingly, the width of each rectangular cut-out 53 along side edges 60,61 should correlate to the width of the U-shaped channel of the elongate connector 40. Side walls 51, each include a circular hole 55 connected by a circular conduit 56 defining a cylindrical passageway for receiving a lockset.

As shown in FIG. 5B, the circular conduit 56 includes a hole 57 corresponding to hole 54 of the central wall 59 and positioned to allow operative communication between a lockset and a striker portion of a lockset. Further, FIG. 5B shows the positioning of the lockset housing 58 between the downturned leg portions 52 of an elongate connector 40. In such embodiments, the elongate connector 40 includes a circular hole 49 in each downturned leg portion 52 corresponding in size with holes 55 of the side walls 51 of the lockset housing 58 and located such that holes 49 superimpose holes 55 when the lockset housing 58 is placed into position. As such, the cylindrical passageway defined by holes 55 and circular conduit 56 of the lockset housing 58 is not obstructed. Additionally, the elongate connector 40 will also include a hole (not shown), preferably rectangular and corresponding in size and shape to hole 92, in the central portion thereof and located such that a passageway is defined through holes 57 and 54 of the lockset housing 58 and travels through the corresponding hole in the elongate connector 40 and ending at side edge 24 of the door 10 with rectangular hole 92. The need for such a continuous passageway is understood in the art.

As referenced earlier, one desirable aspect of metal doors 10 according to the present invention is that the finished door is devoid of welds. Consequently, the metal door 10 is cost-effectively produced. As such, another aspect of the present invention comprises a method of making a metal door 10. Generally speaking, the method comprises cutting sheet metal to provide a pair of sheet metal door panels 20. As described above, each door panel 20 includes a central body portion 21 with top 22, bottom 23 and opposing side edges 24, 25. The metal door panels 20 can be stamped to form any necessary holes, such as circular hole 90 for receiving a lockset. Preferably, the door panels 20 are processed through a roll forming machine or the like to form the integral flange 30 along each side edge 24, 25 of each door panel 20, in which the integral flange extends perpendicular to the central body portion 21. The roll forming machine can also form the integral inturned lip 34 along each flange 30, such that each integral inturned lip 34 extends substantially parallel to the central body portion 21 of the door panel 20.

Once the integral flanges 30 and inturned lips 34 have been formed, the door panels 20 are positioned with the central body portions 21 being in opposing spaced apart relation to one another. As such, the integral flanges 30 are adjacent to and aligned with one another and the inturned lips 34 are positioned in contacting face-to-face relation. The elongate connectors 40 are positioned such that they overlie each face-to-face pair of inturned lips 34, thus providing an assembled door. Pressure is then applied to the thus-assembled door panels 20 and elongate connectors 40 to crimp the inturned lips 34 and the side walls 48 of the elongate connectors 40 to secure the door panels 20 in assembled relation.

Figure 6A:
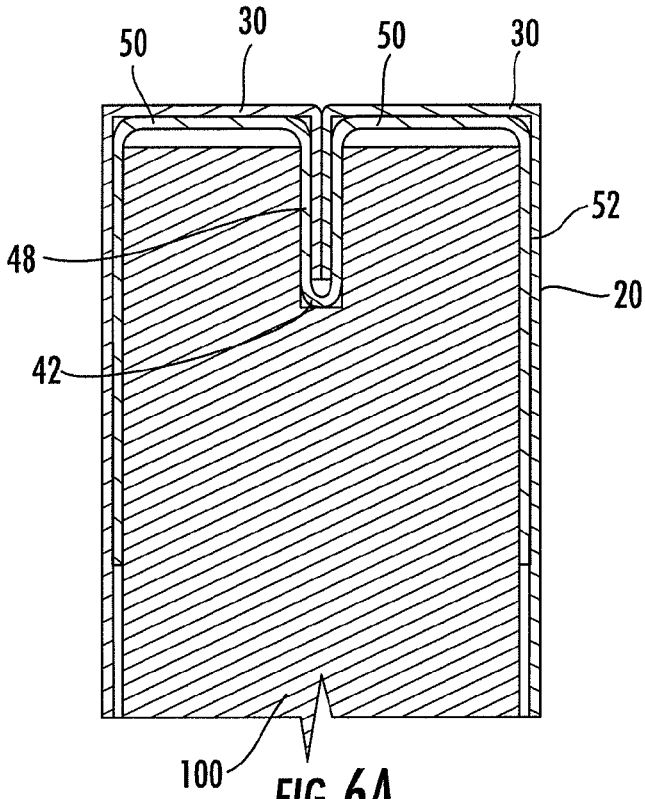
FIG. 6A is a cross-sectional view illustrating the positioning of an elongate connector onto a door mold and the positioning of the inturned lips of two door panels within the channel of an elongate connector according to steps in a process for assembling a door according to one embodiment of the present invention.
Figure 6B:
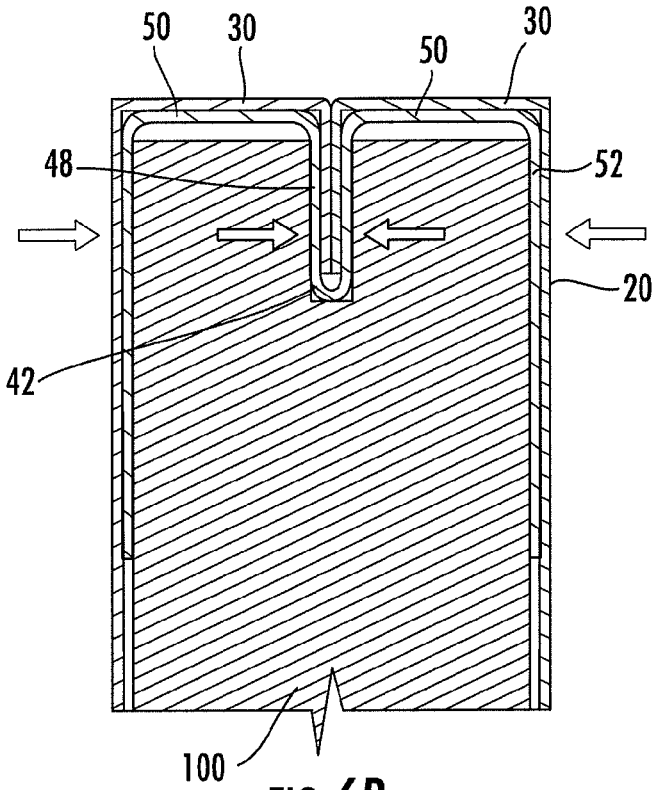
FIG. 6B illustrates a step of applying pressure to the assembled door panels as shown in FIG. 6A to crimp the inturned lips and elongate connector to secure together the door panels and the elongate connector in an assembled relation.

FIGS. 6A and 6B illustrate a preferred technique utilized for joining the door panels 20 to one another. First, a mounting mold 100 is provided having a longitudinal groove of a width roughly corresponding to the width of the U-shaped channel of the elongate connector 40 such that the U-shaped channel can be received within the groove of the mold. Additionally, the mold 100 should include a cut-out to allow for the lockset housing 58 to reside therein. An elongate connector 40 is positioned over the top of the mounting mold 100. After the elongate connector is in position, the inturned lips 34 of each panel 20 are then inserted into the U-shaped channel of the elongate connector 40. More specifically a single pair of face-to-face inturned lips 34 is placed into the U-shaped channel. After the door panels 20 and the elongate connector 40 are positioned in an assembled relationship, a step of applying pressure, preferably via a machine press or the like, is performed by pressing the flanges 30 toward the mounting mold to force the inturned lips 34 inwardly toward the groove of the mounting mold is performed as shown in FIG. 6B. The applied pressure is sufficient to crimp the inturned lips 34 and the side walls 48 of the elongate connector 40, thus securing the door panels 20 in an assembled relation along the opposite side edges of the door. After securing the door panels 20 on one side, the second pair of inturned lips 34 is similarly secured with a second elongate connector 40.

As discussed briefly above, one of the elongate connectors 40 should preferably have downturned leg portions 52 of sufficient length to accommodate a lockset housing 58 therein. As such, a lockset housing 58 described herein and illustrated by FIG. 5A can be inserted between the downturned leg portions 52 of this elongate connector 40 as depicted in FIG. 5B. The lockset housing 58 is typically mounted within the elongate connector 40 prior to the step of crimping the door panels 20 and elongate connector together. The elongate connector 40 receiving the lockset housing 58 should also include a hole (not shown), preferably rectangular and corresponding in size and shape to hole 92, in the central portion thereof and located such that a passageway is defined through holes 57 and 54 of the lockset housing 58 and travels through the corresponding hole in the elongate connector 40 and ending at a side edge 24 of the door 10 with rectangular hole 92. The need for such a continuous passageway is understood in the art.

In certain embodiments, the application of crimping pressure is uniformly applied substantially along the length of the door panels 20 corresponding to the length of the integral flanges 30. Alternatively, the application of pressure can be applied to the assembled door panels 20 and elongate connectors 40 in a manner to crimp only discrete portions of the inturned lips 34 and side walls 48 of each elongate connector 40 to secure the door panels 20 in an assembled relation. As such, the crimped portion of inturned lips 34 and elongate connector 40 can vary. In such embodiments, the application of crimping pressure is applied to about 5 to about 10, preferably 7, discrete zones along the length of the door panels 20. By way of example, each discrete zone can comprise from about 1 foot to about 5 feet. For instance, it may be desirable to not apply the crimping pressure at the location of an elongate connector 40 having a lockset housing 58 disposed therein.

Figure 7:
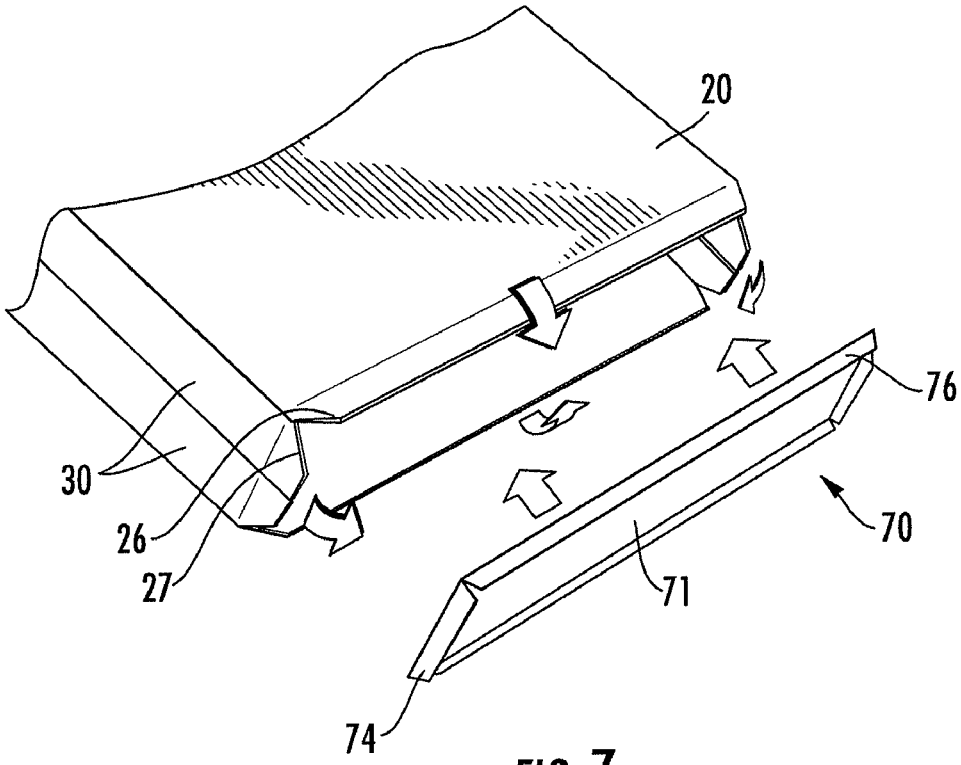
FIG. 7 illustrates a top or bottom rail having an integral flange along each side edge, in which the top or bottom rail is being positioned between interconnected door panels along the top or bottom edges of the door panels according to one embodiment of the present invention.

After the door panels 20 have been secured, the mounting mold 100 is removed from the assembled panels 20 and the openings at the top and bottom of the door 10 are closed. As illustrated by FIG. 7, pre-formed top and bottom rails 70 are then inserted between the interconnected door panels 20 and extend respectively along the top and bottom edges 22, 23 thereof. Each rail 70 includes a central body portion 71 and integral flanges 74, 76 along each side edge of each rail extending perpendicular to the central body portion 71. The top and bottom rails 70 are preferably machine formed to tightly fit between the assembled door panels 20. As such, the rails 70 can be situated between the interconnected panels 20 by tapping them in place with a rubber mallet or the like. As shown in FIG. 7, each rail 70 can include a pair of long flanges 76 that lie parallel and adjacent to the central portion 21 of the door panels 20 and a pair of short flanges 74 that lie parallel and adjacent to the integral flanges 30 of the door panels 20 upon positioning the rails 70 between the door panels 20.

Figure 8:
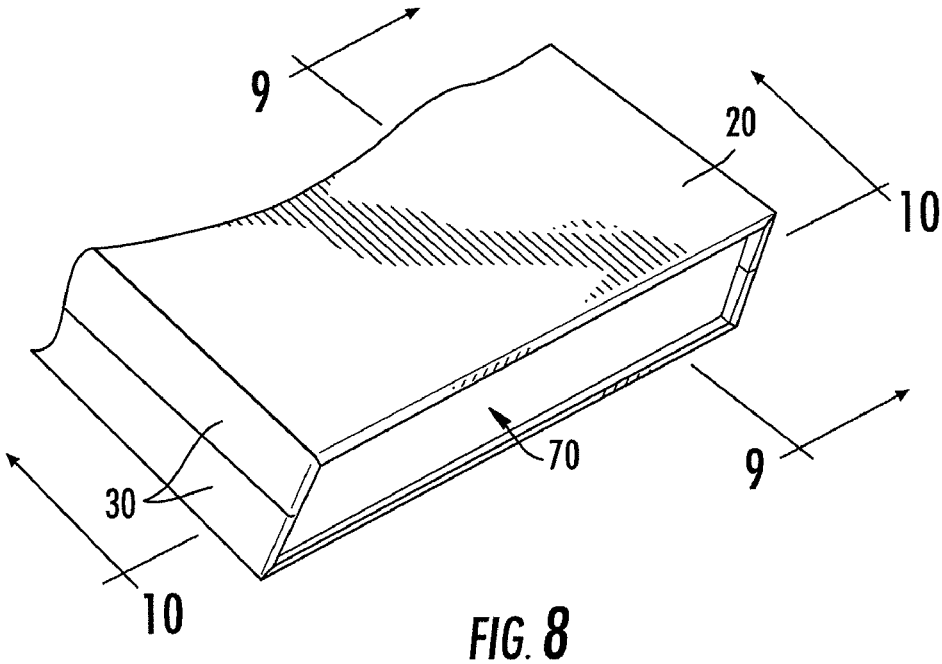
FIG. 8 illustrates a top or bottom rail positioned between interconnected door panels along the top or bottom edges of the door panels, wherein the top or bottom edges include a 180 degree U-bend such that the sheet metal of the door panel adjacent each U-bend overlies and clamps onto the integral flanges of the top or bottom rail according to one embodiment of the present invention.

As shown in FIG. 8, once the rails 70 are positioned between the assembled door panels 20, the sheet metal of the door panels 20 and integral flanges 30 along the top and bottom edges 22, 23 can be bent to form 180 degree U-bends so that the sheet metal of the door panels 20 and integral flanges 30 wrap over and around the rail flanges 74, 76 of each rail. Preferably, the sheet metal wrapping over the rail flanges 74, 76 is crimped onto the rail flanges 74, 76 to secure the rails 70 in position by the application of sufficient pressure as is understood in the art. As such, a portion of the sheet metal of the door panel 20 and integral flanges 30 adjacent each 180 degree U-bend overlies and clamps onto a respective integral flange 74, 76 of each rail 70.

Figure 9:
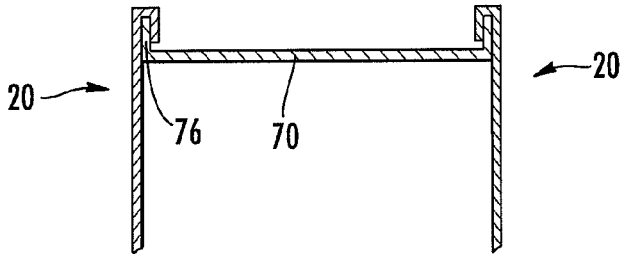
FIG. 9 is a cross-sectional view taken along line 9-9 of FIG. 8, which depicts flanges of a top or bottom rail secured to the sheet metal of the assembled door panels according to one embodiment.
Figure 10:
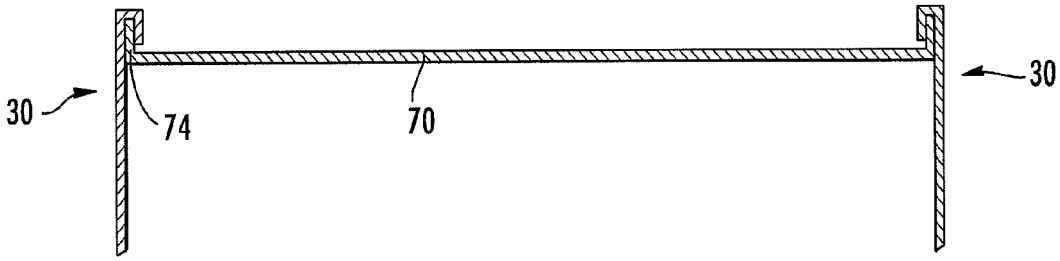
FIG. 10 is a cross-sectional view taken along line 10-10 of FIG. 8, which depicts flanges of a top or bottom rail secured to the sheet metal of the integral flanges of the door panels according to one embodiment.

FIGS. 9 and 10 illustrate in greater detail a top or bottom rail 70 being secured in place by the bending of the sheet metal of the door panels 20 and the integral flanges 30 around the flanges 74, 76. For instance, FIG. 9 illustrates flanges 76 of a rail 70 secured to the sheet metal of the door panels 20. The sheet metal of the door panels 20 is first bent in a right angle and crosses over the top of the rail flanges 76. Either simultaneously, or subsequent to the formation of the right angle bend, the sheet metal is further bent in another right angle such that the sheet metal of the door panels 20 overlies both sides of each flange 76. As such, the sheet metal of the door panels 20 along the top and bottom edges 22, 23 form 180 degree U-bends. Although FIG. 9 depicts the 180 degree U-bends as including two right angle bends, alternative embodiments include a rounded 180 degree U-bend. Similarly, FIG. 10 illustrates flanges 74 of rail 70 secured to the sheet metal of the integral flanges 30 of the door panels 20. Preferably, the top and bottom rails 70 include two sets of flanges 76, 74, which are secured to the sheet metal of the door panels 20 and integral flanges 30, respectively. FIG. 8 illustrates such an embodiment.

Figure 11:
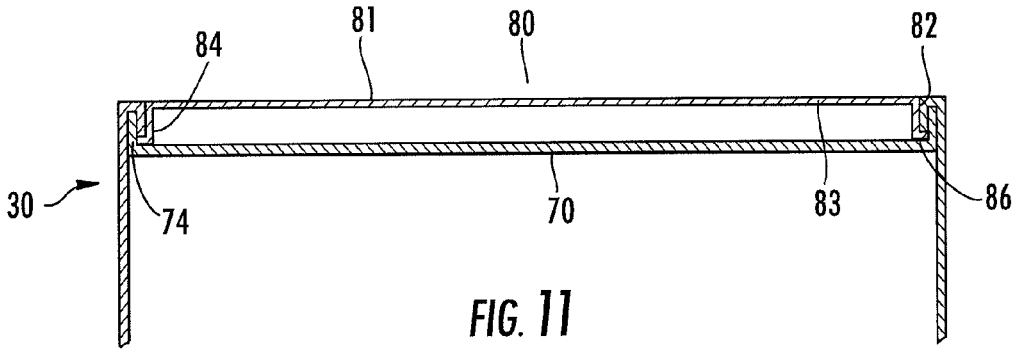
FIG. 11 is a cross-sectional view similar to FIG. 10, which depicts flanges of a top rail secured to the sheet metal of the integral flanges of the door panels and a cover element snapped into location and overlying the top rail according to one embodiment.

As shown in FIG. 11, the door 10 preferably includes a cover element 80 configured to overlie the top rail 70 so that a top surface of the door is flush with the side edge. A similar element can optionally be similarly positioned to overlie the bottom rail 70 if desired. The cover element 80 includes a central body portion 81 with a first pair of opposing side edges 82 and a second pair of opposing side edges 83. The first pair of opposing side edges 82 are shorter than the second pair of opposing side edges 83. The cover element 80 also includes an integral flange 84 along each side edge of the first pair of opposing side edges 82. Preferably, the integral flanges 84 extend perpendicular to the central body portion 81 of the cover element 80. The cover element 80 also includes an integral outturned lip 86 along each flange 84 extending substantially parallel to the central body portion 81 of the cover element 80. The cover element 80 is positioned so that each outturned lip 86 is parallel and adjacent with a portion of the central body portion 71 of the top rail 70 and integral flanges 86 are parallel and adjacent to a portion of the sheet metal adjacent the 180 degree U-bends.

In one embodiment, the cover element 80 is simply snapped into position as depicted in FIG. 11. More specifically, the outturned lips 86 can fit snuggly between the central body portion 71 of the top rail 70 and the end edge of the sheet metal adjacent the 180 degree U-bends to secure the cover element 80 to the assembled door 10. As such, the cover element 80 is secured into position, preferably, by a snap-like fit where the frictional engagement between the metal components helps secure the cover element 80 in place.

As previously referenced, the assembled door panels 20 define an interior cavity 60 within the door 10, wherein the interior cavity is substantially filled with expandable foam. Preferably, the cavity 60 is substantially filled with open or closed cell foam. More preferably, the foam comprises polyurethane foam. The expandable foam can be injected into the cavity 60 after the positioning of the top and/or bottom rails 70. For instance, the top or bottom rail 70 can include a hole (not shown) through which expandable foam can be injected into the cavity 60.

According to embodiments of the present invention, the metal door 10 can comprise a wide range of metals commercially available and known for the manufacture of doors and the like. Preferably, all of the components of the metal door 10 are aluminum. More preferably, all components of the metal door 10 comprise an aluminum-zinc alloy to provide a door highly resistant to corrosion. Such alloys are often referred to as galvaluminum. In one embodiment, the aluminum-zinc alloy includes about 55% Al and 45% Zn. The aluminum-zinc alloy combines the independently desirable corrosion resistant properties of aluminum and zinc. Specifically, the aluminum component of the alloy provides excellent long-term atmospheric-corrosion resistance while the zinc component of the alloy provides sacrificial protection.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A metal door, comprising:

a pair of sheet metal door panels, each having a central body portion with top, bottom and opposing side edges;

an integral flange along each side edge of each panel extending perpendicular to the central body portion;

an integral inturned lip along each flange extending substantially parallel to the central body portion;

said door panels being positioned with said central body portions in opposing spaced apart relation to one another with said flanges adjacent to and aligned with one another and with said inturned lips positioned in contacting relation;

an elongate connector overlying each contacting pair of inturned lips;

said elongate connector and contacting pair of inturned lips crimped together along a length of the door panels to define at least one crimped section, the at least one crimped section securing the door panels in an assembled relation;

top and bottom rails positioned between the door panels and extending respectively along the top and bottom edges thereof, wherein each rail includes a central body portion and an integral flange along each side edge of each rail and extending perpendicular to the central body portion and a 180 degree U-bend formed in the sheet metal of said door panels along said top and bottom edges, so that a portion of the sheet metal of the door panel adjacent said bend overlies and clamps onto said integral flange of each rail; and a cover element comprising (i) a central body portion with a first pair of opposing side edges and a second pair of opposing side edges, wherein said first pair of opposing side edges are shorter than said second pair of opposing side edges; (ii) an integral flange along each side edge of said first pair of opposing side edges and extending perpendicular to the central body portion of the cover element; and (iii) an integral outturned lip along each flange extending substantially parallel to the central body portion of the cover element; said cover element being positioned so that each outturned lip is parallel and adjacent to a portion of the central body portion of the top rail and said integral flanges are parallel and adjacent to a portion of the sheet metal adjacent said 180 degree U-bend.

2. The metal door of claim 1, wherein the elongate connector comprises an elongate metal strip, a longitudinally extending bend formed in a central portion of the strip defining a generally U-shaped channel with opposed, generally parallel side walls, and wherein said contacting pair of inturned lips is positioned in said channel surrounded by said side walls, said inturned lips and side walls being crimped together along the length of the door panels to define the at least one crimped section.

3. The metal door of claim 2, wherein said elongate metal strip includes integral outturned flange portions joined to said side walls by a right angle bend and positioned adjacent said integral flanges, and integral downturned leg portions joined to said outturned flange portions by a right angle bend and positioned adjacent said panels.

4. The metal door of claim 1, wherein the opposing spaced apart door panels define an interior cavity within the door, and including foam substantially filling the cavity.

5. The metal door of claim 4, wherein the foam comprises polyurethane foam.

6. The metal door of claim 1, including a circular hole formed in said panels adjacent one side edge thereof for receiving a lockset.

7. The metal door of claim 6, additionally including a rectangular hole formed in said flanges adjacent said circular hole for receiving the striker portion of a lockset.

8. The metal door of claim 7, additionally including a lockset housing mounted in the elongate connector which is adjacent said circular hole, the lockset housing including a wall with a hole formed therein positioned in alignment with said circular hole in said panels and a rectangular hole positioned in alignment with said rectangular hole.

9. The metal door of claim 6, including hinges attached to said flanges on the side edge opposite said one side edge.

10. The metal door of claim 1, including decorative relief panel formations stamped in the central body portion of said panels.

11. The metal door of claim 1, wherein the door is devoid of welds.

12. The metal door of claim 1, wherein the at least one crimped section comprises one or more discrete crimped sections.

13. A metal door, comprising:

a pair of rectangular sheet metal door panels, each having a central body portion with top, bottom and opposing side edges;

an integral flange along each side edge of each panel extending perpendicular to the central body portion;

an integral inturned lip along each flange extending substantially parallel to the central body portion;

said door panels being positioned with said central body portions in opposing spaced apart relation to one another with said flanges adjacent to and aligned with one another and with said inturned lips positioned in contacting relation;

an elongate connector overlying and clamping together each contacting pair of inturned lips to maintain the door panels in assembled relation, said connector comprising an elongate metal strip with a longitudinally extending bend formed in a central portion of the strip and defining a generally U-shaped channel with opposed, generally parallel side walls, wherein said contacting pair of inturned lips is positioned in said channel surrounded by said side walls, at least one section of said inturned lips and side walls being crimped together along a length of the door panels to define at least one crimped section, the at least one crimped section securing the door panels in an assembled relation;

top and bottom rails positioned between the door panels and extending respectively along the top and bottom edges thereof, wherein each rail includes a central body portion and an integral flange along each side edge of each rail and extending perpendicular to the central body portion; and a 180 degree U-bend formed in the sheet metal of said door panels along said top and bottom edges, so that a portion of the sheet metal of the door panel adjacent said bend overlies and clamps onto said integral flange of each rail; and a cover element comprising (i) a central body portion with a first pair of opposing side edges and a second pair of opposing side edges, wherein said first pair of opposing side edges are shorter than said second pair of opposing side edges; (ii) an integral flange along each side edge of said first pair of opposing side edges and extending perpendicular to the central body portion of the cover element; and (iii) an integral outturned lip along each flange extending substantially parallel to the central body portion of the cover element; said cover element being positioned so that each outturned lip is parallel and adjacent to a portion of the central body portion of the top rail and said integral flanges are parallel and adjacent to a portion of the sheet metal adjacent said 180 degree U-bend.

14. The metal door of claim 13, wherein the opposing spaced apart door panels define an interior cavity within the door, and including foam substantially filling the cavity.

15. The metal door of claim 13, including a cover overlying the central body portion of said top rail and presenting a top door surface flush with said integral flange.

* * * * *